US008528913B2

(12) United States Patent
Eggert et al.

(10) Patent No.: US 8,528,913 B2
(45) Date of Patent: Sep. 10, 2013

(54) DRESSING ROLL MOUNTING DEVICE

(75) Inventors: Dirk Eggert, Bergfelde (DE); Jan-Marc Lischka, Berlin (DE)

(73) Assignee: Siemens Aktiengesellschaft, München (DE)

( * ) Notice: Subject to any disclaimer, the term of this patent is extended or adjusted under 35 U.S.C. 154(b) by 611 days.

(21) Appl. No.: 12/702,658

(22) Filed: Feb. 9, 2010

(65) Prior Publication Data

US 2010/0204029 A1 Aug. 12, 2010

(30) Foreign Application Priority Data

Feb. 10, 2009 (EP) ..... 09001824

(51) Int. Cl.
*B21B 41/04* (2006.01)

(52) U.S. Cl.
USPC ..... 279/102; 279/103; 451/512; 451/56; 451/444; 29/253; 29/278

(58) Field of Classification Search
USPC ..... 29/895.2, 464, 433, 423, 241, 253, 29/282, 271, 272, 278, 280; 451/348, 177, 451/208, 512, 56, 443, 444; 279/102, 103; 7/167; 81/489
See application file for complete search history.

(56) References Cited

U.S. PATENT DOCUMENTS

| | | | | |
|---|---|---|---|---|
| 1,918,392 | A * | 7/1933 | Hohnhorst et al. | 451/342 |
| 2,088,084 | A * | 7/1937 | Gould | 125/5 |
| 2,133,386 | A * | 10/1938 | Galloway | 451/121 |
| 2,167,014 | A * | 7/1939 | Verderber | 279/83 |
| 2,443,789 | A * | 6/1948 | Flygare | 125/11.03 |
| 2,576,239 | A * | 11/1951 | Reimschissel et al. | 451/21 |
| 2,675,653 | A * | 4/1954 | Bryant | 451/342 |
| 2,937,575 | A * | 5/1960 | McCoskey | 409/232 |
| 3,362,802 | A * | 1/1968 | Ellis | 428/564 |
| 4,829,718 | A * | 5/1989 | Behm | 451/342 |
| 6,572,442 | B2 * | 6/2003 | Sakai et al. | 451/5 |
| 6,647,606 | B2 * | 11/2003 | Hibi | 29/271 |

FOREIGN PATENT DOCUMENTS

| | | | |
|---|---|---|---|
| CN | 1246217 | A | 3/2000 |
| CN | 1461892 | A | 12/2003 |
| CN | 2686807 | Y | 3/2005 |
| DE | 3207921 | A1 | 11/1982 |
| DE | 8316839 | U1 | 12/1984 |
| DE | 3531044 | A1 | 3/1987 |
| JP | 2003165021 | A | 6/2003 |
| RU | 2090338 | C1 | 9/1997 |

OTHER PUBLICATIONS

Cverna, Fran; Conti, Patricia (2006). Worldwide Guide to Equivalent Irons and Steels (5th Edition). ASM International. Online version available at: http://www.knovel.com/web/portal/browse/display?_EXT_KNOVEL_DISPLAY_bookid=3126&VerticalID=0.*

* cited by examiner

*Primary Examiner* — David Bryant
*Assistant Examiner* — Jason L Vaughan

(57) ABSTRACT

A dressing roll mounting device for mounting a dressing roll to a dresser shaft of a grinding wheel dressing unit is provided. The dressing roll mounting device includes a mounting sleeve to be positioned at a free end of the dresser shaft, the outer face of the mounting sleeve being provided with a conical mounting region serving as a centering and pushing-on aid during mounting of the dressing roll to the dresser shaft. The maximum outside diameter of the conical mounting region is smaller than or corresponding to a dressing roll reception diameter of the dresser shaft.

7 Claims, 2 Drawing Sheets

DRESSING ROLL MOUNTING DEVICE

CROSS REFERENCE TO RELATED APPLICATIONS

This application claims priority of European Patent Office Application No. 09001824.3 EP filed Feb. 10, 2009, which is incorporated by reference herein in its entirety.

FIELD OF INVENTION

The present invention relates to a dressing roll mounting device for mounting a dressing roll on a dresser shaft of a grinding wheel dressing unit.

SUMMARY OF INVENTION

Grinding wheel dressing units serve for the profiling of grinding wheels and are often integrated directly in grinding machines. They have a specific drive unit for driving a dresser shaft on which the dressing roll is mounted. By the rotating dressing roll being dipped into the rotating grinding wheel, a dressing of the grinding wheel profile takes place. Dressing may take place intermittently or continuously during the machining of a work piece by the grinding wheel, continuous dressing being advantageous in that a clogging of the grinding wheel with metal particles is prevented and therefore a constantly sharp grinding wheel is guaranteed. The reduction in the grinding wheel diameter which occurs due to the grinding wheel wear during machining and as a result of the dressing process is compensated with the aid of a corresponding infeed of the dressing roll.

In the process of deep grinding turbine blades, especially narrow tolerances have to be manufactured. For profiling the grinding wheels used, as a rule, electrolytically bound diamond dressing rolls are employed. These are joined to dresser shafts by means of a transition fit and are thus mounted or driven in the grinding machine. In this case, very high tolerance requirements are demanded for achieving a proper concentricity and axial run-out. The mounting of the dressing rolls on the dresser shafts normally takes place either directly in the machining space of the grinding machine or in workshop surroundings, in the latter case the demounting of the dresser shaft, together with the dressing roll, and transport into the workshop being required. During the mounting and demounting of the dressing roll on and from the dresser shaft, it is necessary at the present time to have additional dressing roll mounting devices, such as, for example, hot cabinets, cold cabinets, press-in presses or the like. Nevertheless, a tilting of the dressing roll and dresser shaft during mounting or demounting often cannot be prevented, and therefore the shafts and/or bores, manufactured with high precision, of the components to be joined together are damaged.

An object of the present invention is to provide a dressing roll mounting device of the type initially mentioned, in which damage to the shaft and/or bore, manufactured with high precision, of the components to be joined together is prevented. Moreover, an easy dressing roll mounting and, if appropriate, also demounting of dressing rolls in the machining space of grinding machines are to be made possible. A further object is to provide a dressing roll mounting device in which complicated mounting aids, in particular hot cabinets and cold cabinets, can be dispensed with.

This object is achieved, according to the present invention, in that the dressing roll mounting device has a mounting sleeve which can be positioned at a free end of the dresser shaft and the outer face of which is provided with a conical mounting region which serves as a centering and pushing-on aid during the mounting of the dressing roll on the dresser shaft, a maximum outside diameter of the conical mounting region being smaller than a dressing roll reception diameter of the dresser shaft or corresponding to this.

Accordingly, the dressing roll bore is not pushed directly onto the end of the dresser shaft, but, instead, first onto the conical mounting region of the dressing roll mounting device, the diameter of which mounting region is smaller than or equal to the dressing roll reception diameter of the dresser shaft. Thus, a tilting of the dressing roll of the dresser shaft, when the dressing roll is being placed onto the dresser shaft, and correspondingly damage to the bore or shaft manufactured with high precision can be reliably prevented. Correspondingly, a mounting or demounting of the dresser shaft can also take place relatively easily in the machining space of a grinding machine. Furthermore, the automatic centering of the dressing roll bore with respect to the dresser shaft, when it is being pushed onto the conical mounting region of the dressing roll mounting device according to the invention, and the accompanying optimized orientation of the components to be joined together can make the use of hot and/or cold cabinets unnecessary. Mounting/demounting times and/or costs can be reduced correspondingly.

The outer face of the mounting sleeve may be provided with a conical demounting region which serves as a stripping aid during the demounting of the dressing roll from the dresser shaft. Demounting is thereby also made appreciably easier.

The mounting region and the demounting region are advantageously arranged in such a way that they merge one into the other. The demounting region preferably faces the dresser shaft in the intended state of the dressing roll mounting device, while the mounting region faces away from the dresser shaft.

The mounting region and, if present, the demounting region preferably extend over the entire length of the mounting sleeve, so that the latter is utilized optimally.

The mounting sleeve is preferably designed in such a way that it can be fastened to a spindle journal of the dresser shaft. In this case, the dressing roll mounting device can be mounted on the dresser shaft particularly simply.

The mounting sleeve is preferably produced from a material of high hardness, such as, for example, from an advantageously hardened chrome/nickel alloy.

BRIEF DESCRIPTION OF THE DRAWINGS

With regard to further preferred embodiments of the present invention, reference is made to the dependent claims and to the following description of exemplary embodiments by means of the accompanying drawing in which:

DETAILED DESCRIPTION OF INVENTION

Figure 1:
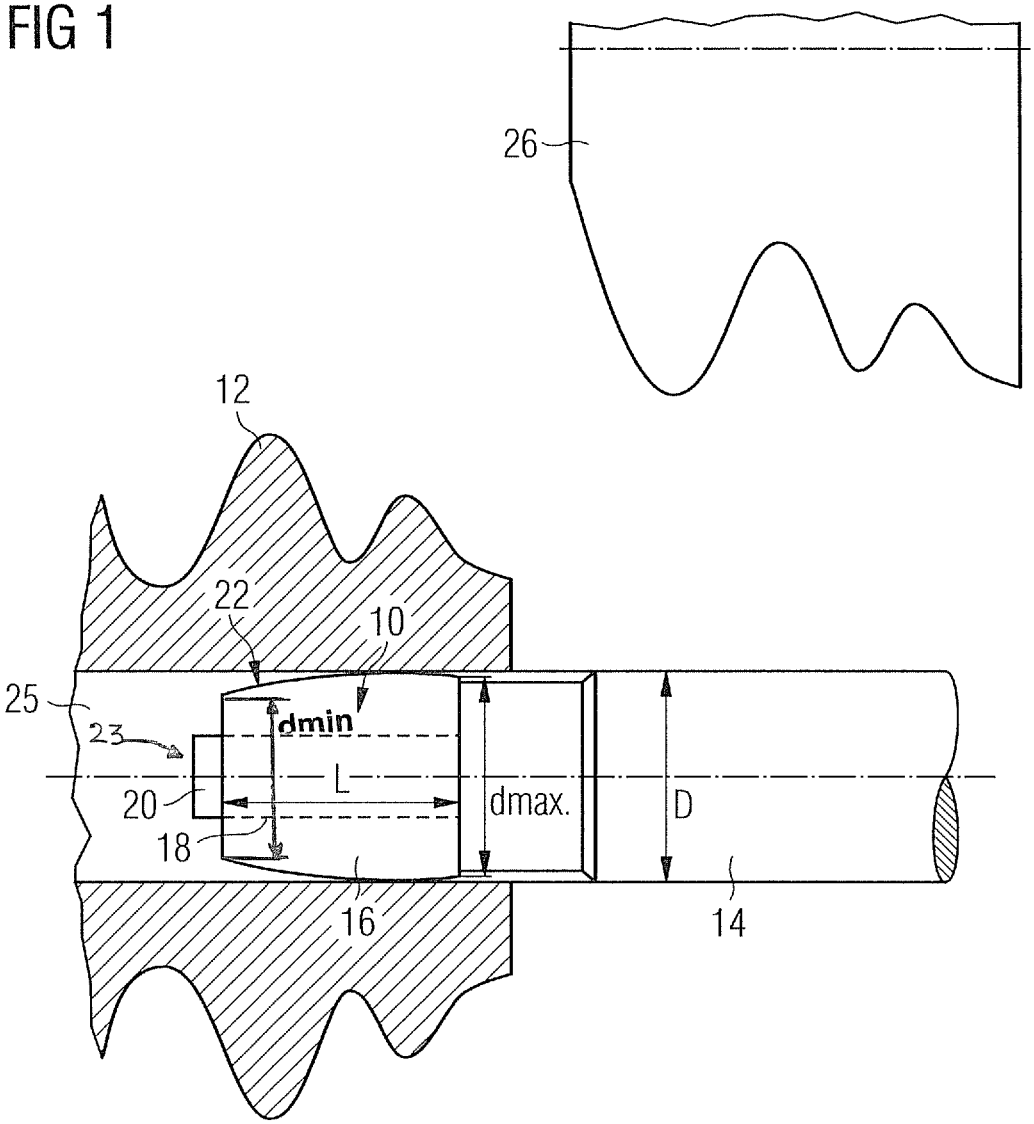
FIG. 1 shows a diagrammatic view of a grinding machine inner space with a dressing roll mounting device according to a first embodiment of the present invention during the mounting of a dressing roll on a dresser shaft.

FIG. 1 shows a dressing roll mounting device 10 during the mounting of a dressing roll 12 on a dresser shaft 14 of a grinding wheel dressing unit, not illustrated in any more detail. The dressing roll mounting device 10 consists of an elongate mounting sleeve 16 which is provided centrically with a through bore 18. In the state illustrated in FIG. 1, this mounting sleeve 16 is fastened to the spindle journal 20 of the dresser shaft 14, which spindle journal is received in a corresponding mounting during the normal operation of the grinding machine dressing unit. To make it easier to mount the dressing roll 12 on the dressing roll reception diameter D of the dresser shaft 14, the outer face of the mounting sleeve 16 is provided along its entire length L with a conical mounting region 22, the outside diameter of which tapers from a maximum outside diameter $d_{max}$ in the direction of the free end 23 of the spindle journal 20 to a minimum outside diameter $d_{min}$, $d_{max}$ being ≦the dressing roll reception diameter D. Accordingly, the dressing roll 12, when being drawn onto the mounting sleeve 16, is automatically centered, by the cooperation of the outer face of the mounting sleeve 16 and of the wall of the dressing roll bore 25, with respect to the dressing roll reception diameter D of the dresser shaft 14, on which diameter the dressing roll 12 is ultimately to be fastened. By virtue of this centering, an optimal orientation of the dresser shaft 14 and of the dressing roll 12 with respect to one another takes place, so that, when the dressing roll 12 is being drawn onto the dressing roll reception diameter D of the dresser shaft 14, no tilting of the components occurs. Damage to the dressing roll bore 25 and dresser shaft 14 which are manufactured with high precision is also consequently prevented. Moreover, the use of hot and/or cold cabinets may be dispensed with. It is also possible to carry out the mounting of the dressing roll 12 inside the grinding machine work space, as indicated in FIG. 1 by the presence of the grinding wheel 26.

As soon as the dressing roll 12 is positioned properly on the dresser shaft 14, the mounting sleeve 16 can be drawn off from the spindle journal 20, so that the spindle journal 20 can be received in its mounting again (not shown). The dressing roll 12 is also secured beforehand by means of corresponding fastening elements (not shown), one of which is screwed onto an external thread of the dresser shaft 14.

To demount the dressing roll 12, the mounting sleeve 16 is positioned on the spindle journal 20 of the dresser shaft 14 again, so that the dressing roll 12 can be drawn off, guided by the mounting sleeve 16, from the dresser shaft 14. In this case, too, damage to the dressing roll bore 25 of the dresser shaft 14 is prevented due to the guidance afforded by the mounting sleeve 16.

Figure 2:
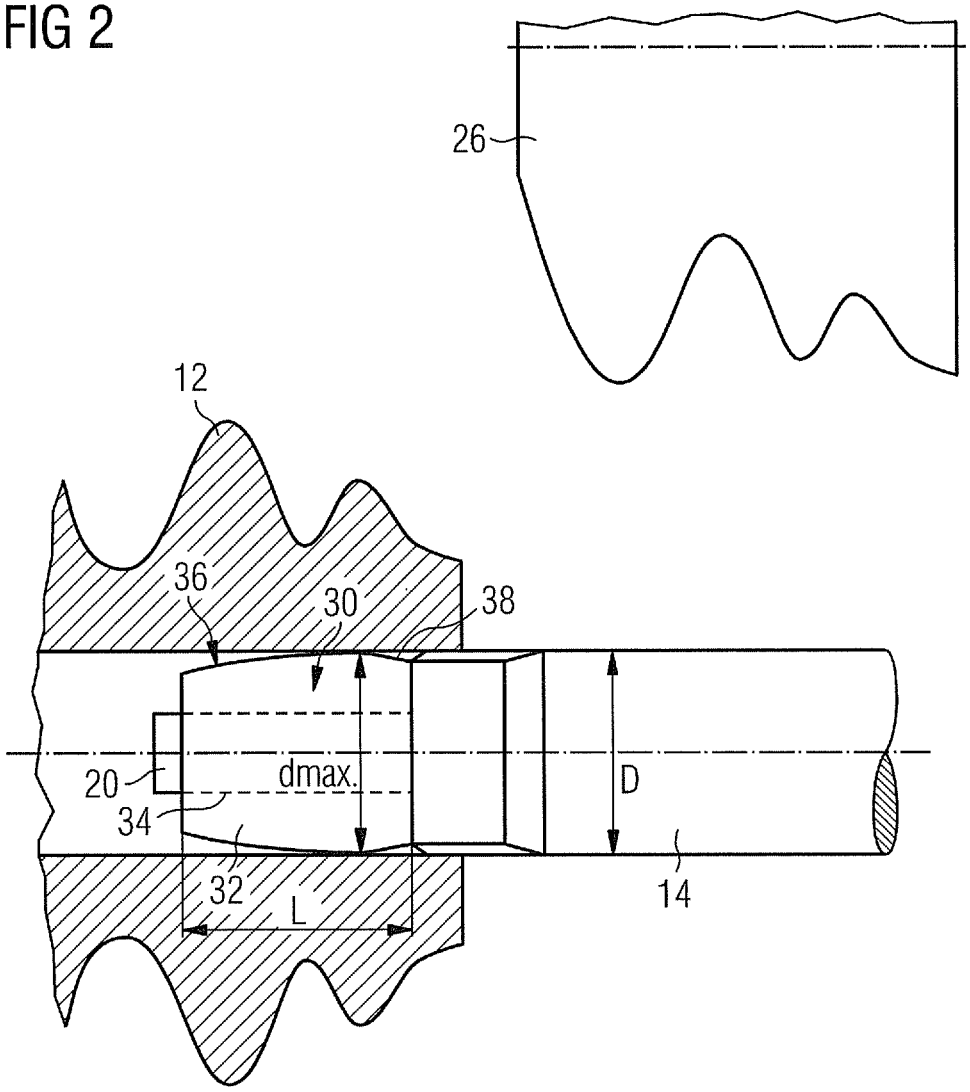
FIG. 2 shows a diagrammatic view of a grinding machine inner space with a dressing roll mounting device according to a second embodiment of the present invention during the mounting of a dressing roll on a dresser shaft.

FIG. 2 shows an arrangement similar to that of FIG. 1, but in this case, instead of the dressing roll mounting device 10, an alternative dressing roll mounting device 30 according to a second embodiment of the present invention is provided. The dressing roll mounting device 30 is provided in the form of an elongate mounting sleeve 32 which consists of a hardened chrome/nickel alloy and through which a through bore 34 extends centrically. Like the mounting sleeve 16, the mounting sleeve 32, too, is fastened to a spindle journal 20 of the dresser shaft 14. To make mounting easier, the outer face of the mounting sleeve 32 is provided with a conical mounting region 36 which extends from a free end of the mounted mounting sleeve 32 over about ¾ of the length L of the mounting sleeve 32 and gradually widens to a maximum outside diameter $d_{max}$, $d_{max}$ being ≦the dressing roll reception diameter D. The mounting region 36 has adjoining it, without any transition, a demounting region 38, the outside diameter of which tapers again as far as the end of the mounting sleeve 32. The mounting region 36 of the mounting sleeve 32 exerts essentially the same action as the mounting region 22 of the mounting sleeve 16 of the dressing roll mounting device 10 illustrated in FIG. 1, and therefore this is not dealt with once again. The demounting region 38 of the mounting sleeve 16 makes it easier to draw off the dressing roll 12 from the dresser shaft 14 during demounting.

The invention claimed is:

1. A dressing roll mounting device for mounting a dressing roll to a dresser shaft of a grinding wheel dressing unit, comprising:

a mounting sleeve to be positioned at a free end of the dresser shaft, the outer face of the mounting sleeve being provided with a conical mounting region serving as a centering and pushing-on aid during mounting of the dressing roll to the dresser shaft, wherein a maximum outside diameter of the conical mounting region is smaller than a dressing roll reception diameter of the dresser shaft, or corresponds to said dressing roll reception diameter of the dresser shaft, wherein the outer face of the mounting sleeve is provided with a conical demounting region serving as a stripping aid during demounting of the dressing roll from the dresser shaft, and wherein the conical mounting region and the conical demounting region taper in opposite directions from the maximum outer diameter, towards a first end and a second end of the mounting sleeve respectively.

2. The dressing roll mounting device as claimed in claim 1, wherein the mounting region and the demounting region merge one into the other.

3. The dressing roll mounting device as claimed in claim 1, wherein the mounting region extends over an entire length of the mounting sleeve.

4. The dressing roll mounting device as claimed in claim 1, wherein the mounting region and the demounting region extend over an entire length of the mounting sleeve.

5. The dressing roll mounting device as claimed in claim 1, wherein the mounting sleeve is designed such that it can be fastened to a spindle journal of the dresser shaft.

6. The dressing roll mounting device as claimed in claim 1, wherein the mounting sleeve comprises material with high hardness.

7. The dressing roll mounting device as claimed in claim 6, wherein the mounting sleeve comprises hardened chrome-nickel-alloy.

* * * * *